US010267568B2

(12) United States Patent
Dede et al.

(10) Patent No.: US 10,267,568 B2
(45) Date of Patent: Apr. 23, 2019

(54) PROGRAMMABLE ULTRASONIC THERMAL DIODES

(71) Applicant: Toyota Motor Engineering & Manufacturing North America, Inc., Erlanger, KY (US)

(72) Inventors: Ercan M. Dede, Ann Arbor, MI (US); Feng Zhou, South Lyon, MI (US); Shailesh N. Joshi, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 307 days.

(21) Appl. No.: 15/151,679

(22) Filed: May 11, 2016

(65) Prior Publication Data

US 2017/0328648 A1 Nov. 16, 2017

(51) Int. Cl.

| | |
|---|---|
| ***F28D 15/02*** | (2006.01) |
| ***F28D 15/06*** | (2006.01) |
| ***F28D 15/04*** | (2006.01) |
| ***F28F 13/10*** | (2006.01) |

(52) U.S. Cl.

CPC ..... *F28D 15/025* (2013.01); *F28D 15/0233* (2013.01); *F28D 15/04* (2013.01); *F28D 15/06* (2013.01); *F28F 13/10* (2013.01); *F28F 2245/02* (2013.01)

(58) Field of Classification Search

CPC ..... F28D 2015/0216; F28D 15/025; F28D 15/06; F28D 15/04; F28D 15/0233; F28F 13/10

USPC ..... 165/104.22, 104.25

See application file for complete search history.

(56) References Cited

U.S. PATENT DOCUMENTS 4,387,762 A * 6/1983 Rinderle ..... B29C 45/7331 165/104.27
4,967,829 A * 11/1990 Albers ..... F28F 13/02 165/109.1
5,771,967 A * 6/1998 Hyman ..... B64G 1/50 126/45

(Continued)

FOREIGN PATENT DOCUMENTS

CN 102506598 A 6/2012
CN 203323595 U 12/2013

OTHER PUBLICATIONS

Magdum et al., "Heat transfer enhancement in heat exchanger", http://www.academia.edu/16196667/HEAT_TRANSFER_ENHANCEMENT_IN_HEAT_EXCHANGER. Accessed Feb. 18, 2016.

*Primary Examiner* — Devon Russell
(74) *Attorney, Agent, or Firm* — Dinsmore & Shohl, LLP

(57) ABSTRACT

Heat transfer apparatuses and methods for directing heat transfer are disclosed. A heat transfer apparatus includes a vapor chamber having a first surface and a second surface where the first surface and the second surface define a chamber space and at least one of the first surface and the second surface includes a hydrophilic coating. The heat transfer apparatus also includes one or more first ultrasonic oscillators coupled to the first surface, one or more second ultrasonic oscillators coupled to the second surface, and a controller having a non-transitory, processor-readable storage medium storing programming instructions for selectively activating the one or more first ultrasonic oscillators or the one or more second ultrasonic oscillators based on an intended direction of heat flux.

20 Claims, 9 Drawing Sheets

(56) References Cited

U.S. PATENT DOCUMENTS

| | | | | |
|---|---|---|---|---|
| 6,247,525 | B1 * | 6/2001 | Smith | B05B 7/0012 165/104.23 |
| 7,092,254 | B1 * | 8/2006 | Monsef | H01L 23/473 165/80.4 |
| 7,819,556 | B2 * | 10/2010 | Heffington | H04N 9/315 257/715 |
| 8,468,846 | B2 | 6/2013 | Vaidyanathan | |
| 8,739,856 | B2 * | 6/2014 | Fedorov | G06F 1/20 165/80.4 |
| 8,835,063 | B2 | 9/2014 | Lee et al. | |
| 9,945,617 | B2 * | 4/2018 | Fedorov | F28D 15/046 |
| 2006/0060331 | A1 * | 3/2006 | Glezer | F28D 15/0266 165/104.29 |
| 2008/0142195 | A1 * | 6/2008 | Erturk | F28D 15/02 165/94 |
| 2009/0020271 | A1 * | 1/2009 | Yang | F28D 15/0233 165/104.33 |
| 2011/0079372 | A1 * | 4/2011 | Moon | F28D 15/0233 165/104.26 |
| 2012/0012804 | A1 * | 1/2012 | Chen | F28D 15/0233 257/2 |
| 2012/0090825 | A1 * | 4/2012 | Yarin | C25D 5/56 165/185 |
| 2012/0145361 | A1 * | 6/2012 | Glezer | F28F 13/00 165/109.1 |
| 2014/0202665 | A1 * | 7/2014 | Paschkewitz | F28D 15/02 165/104.26 |
| 2017/0125866 | A1 * | 5/2017 | Zhou | H01M 10/6569 |
| 2017/0307308 | A1 * | 10/2017 | Baldwin | F28F 13/003 |
| 2017/0314871 | A1 * | 11/2017 | Basu | F28D 15/025 |
| 2018/0051939 | A1 * | 2/2018 | Cocks | F28D 15/06 |

* cited by examiner

PROGRAMMABLE ULTRASONIC THERMAL DIODES

TECHNICAL FIELD

The present specification generally relates to heat transfer systems and, more specifically, to a system that transmits heat in a programmable direction.

BACKGROUND

Systems that provide heat transfer may generally require specific device conditions to operate. For example, systems that provide heat transfer using a wick or jumping droplets to transfer fluid between hot and cold plates must be particularly oriented with respect to gravity. However, such a particular orientation is difficult when the system is mounted to a moving object, such as one or more components of an automobile.

Accordingly, a need exists for heat transfer system that is not orientation specific and can function under normal operating conditions when installed in a vehicle.

SUMMARY

In one embodiment, a heat transfer apparatus includes a vapor chamber having a first surface and a second surface where the first surface and the second surface define a chamber space and at least one of the first surface and the second surface includes a hydrophilic coating. The heat transfer apparatus also includes one or more first ultrasonic oscillators coupled to the first surface, one or more second ultrasonic oscillators coupled to the second surface, and a controller having a non-transitory, processor-readable storage medium storing programming instructions for selectively activating the one or more first ultrasonic oscillators or the one or more second ultrasonic oscillators based on an intended direction of heat flux.

In another embodiment, a method of directing heat transfer includes designating a first surface of a vapor chamber as a hot surface based on a determined direction of heat transfer, directing heat from an external source towards the first surface, where the heat causes a working fluid adjacent to the first surface to evaporate and condense on a second surface to form a condensed working fluid, and activating one or more ultrasonic oscillators coupled to the second surface, where the one or more ultrasonic oscillators cause the condensed working fluid to atomize and form droplets of working fluid. The droplets of working fluid are attracted to a hydrophilic coating on the first surface and heat is transferred from the first surface to the second surface based on movement of the working fluid.

In yet another embodiment, an ultrasonic thermal diode includes a vapor chamber having a first surface, a second surface and one or more side walls spaced between the first surface and the second surface, where the first surface, the second surface, and the one or more side walls define a chamber space that contains a working fluid and the first surface includes a hydrophilic coating. The ultrasonic thermal diode also includes one or more ultrasonic oscillators coupled to the second surface and separated from the chamber space by a separating membrane and a controller having a processing device and a non-transitory, processor-readable storage medium. The non-transitory, processor-readable storage medium comprising one or more programming instructions that, when executed, cause the processing device to designate the first surface as a hot surface based on a determined direction of heat transfer, direct heat towards the first surface, where the heat causes the working fluid adjacent to the first surface to evaporate and condense on the second surface to form a condensed working fluid, and activate the one or more ultrasonic oscillators coupled to the second surface to form droplets of working fluid from the condensed working fluid. The droplets of working fluid are attracted to the hydrophilic coating of the first surface and heat is transferred from the first surface to the second surface based on movement of the working fluid.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1A:
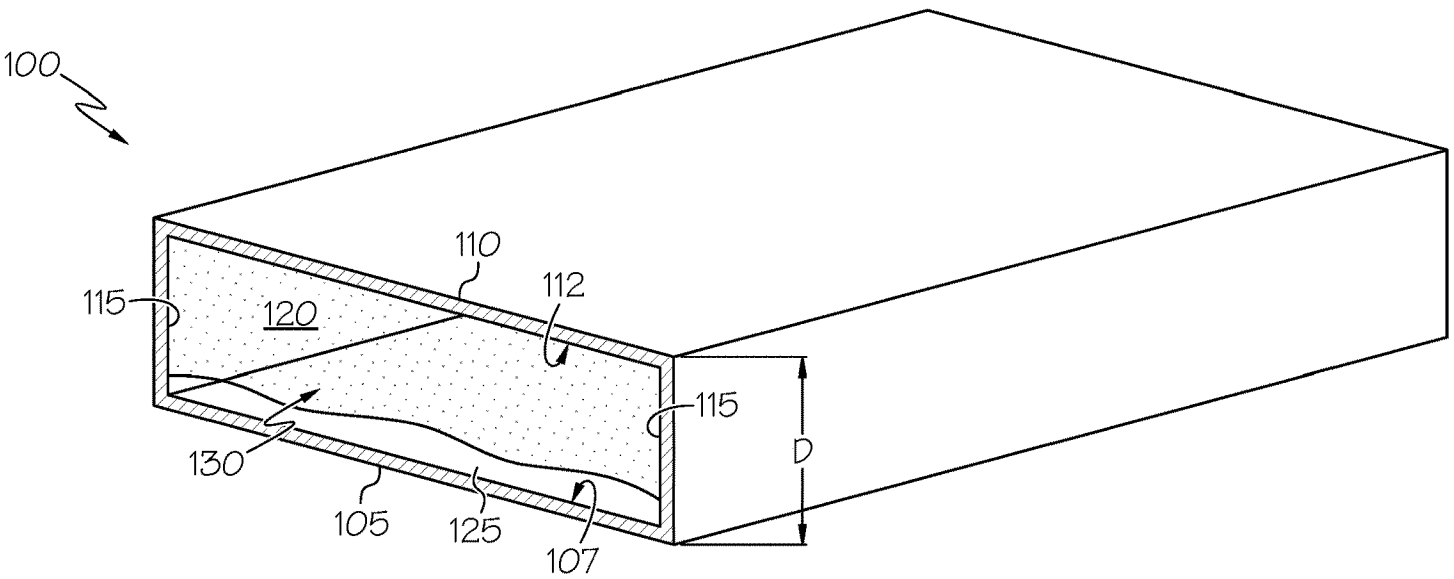
FIG. 1A depicts a side perspective view of an illustrative vapor chamber thermal diode according to one or more embodiments shown and described herein.

The embodiments described herein are generally directed to a vapor chamber that is used for heat transfer by using an ultrasonic thermal diode. The vapor chamber includes two surfaces having a hydrophilic coating thereon, as well as a device for ultrasonicating fluid. As such, the vapor chamber described herein is reversible such that it can receive heat flux at either surface and can transfer the heat to the other surface, regardless of the orientation of the vapor chamber. Such a customizable vapor chamber that can be mounted in any orientation may be particularly suited for moving objects, such as vehicles or the like.

Existing heat transfer systems require a particular orientation to function, as they typically rely on gravity to assist with fluid transfer. For example, a vapor chamber that uses a wick structure or relies on jumping droplets to transfer fluid between hot and cold surfaces of the chamber must be oriented in a particular manner to ensure that the fluid moves under force of gravitational pull. However, in moving vehicles, the direction of the force of gravity with respect to the vapor chamber may be constantly changing, such as when the vehicle is on an incline. In addition, centrifugal forces caused by vehicle movement may also affect fluid movement in such vapor chambers, such as by counteracting the force of gravity. As such, vapor chambers that rely on the force of gravity are unreliable and not suited for vehicular applications.

Other drawbacks of existing heat transfer systems include the requirement of precise monitoring of the amount of fluid within a vapor chamber. For example, if the vapor chamber includes too much fluid, the wick and/or other structures may become flooded, which may cause the vapor chamber to transfer heat less effectively or even fail so that it does not transfer heat at all.

Yet another drawback of existing heat transfer systems is that they must be particularly constructed. For example, all condensable gases must be removed from the vapor chamber during construction thereof. This is because any condensable gases remaining in the vapor chamber could upset the functioning of the chamber. In another example, the vapor chamber must be constructed such that the relative distances between the hot and cold surfaces are maintained according to required lengths so ensure proper functioning of the vapor chamber. As such, the construction process is unnecessarily time consuming and expensive.

Certain existing heat transfer systems are not configurable such that they can transfer heat in any direction. Specifically, existing vapor chambers have a hot surface and a cold surface, which remain hot and cold surfaces, respectively throughout operation of the vapor chamber. That is, the hot surface cannot be switched to function as a cold surface and vice versa. Accordingly, the vapor chamber must be particularly mounted to ensure appropriate functionality.

The present disclosure relates to heat transfer systems that can be mounted in any orientation as they operate regardless of external forces (such as gravitational or centrifugal pull), are not sensitive to the amount of fluid located therein, do not require specific, time consuming, and expensive manufacturing processes, are easily configurable for any application, and can be switched on the fly.

As used herein, a "vapor chamber" generally refers to a sealed vessel containing fluid that vaporizes in the vicinity of a hot surface, migrates to a cooler surface, and condenses at the cooler surface to return to the vicinity of the hot surface. For the purposes of the present disclosure, a vapor chamber is defined to include a heat pipe as a particular type of vapor chamber. The vapor chamber as described herein may contain various components and functionality as is commonly understood for vapor chambers, particularly vapor chambers that act as thermal diodes, except where described otherwise herein.

A "thermal diode" as used herein refers to a heat engine, heat pipe, thermosyphon, or the like that transfers heat in one direction. That is, the thermal diode is oriented so that it transfers heat away from a heat source (e.g., a thermoelectric cooling device, etc.) and has a lower thermoconductivity in directions towards the heat source (e.g., a hot site of a thermoelectric cooling device). The thermal diode may generally be a working fluid-filled closed loop device that incorporates an interconnected evaporator and condenser. For the purposes of the present disclosure, the terms "thermal diode" and "vapor chamber" may be used interchangeably.

FIG. 1A depicts an illustrative vapor chamber, generally designated 100, according to an embodiment. The vapor chamber 100 generally includes a first surface 105, a second surface 110, and one or more side walls 115 positioned between the first surface 105 and the second surface 110. The first surface 105, the second surface 110, and the one or more side walls 115 define a chamber space 120 therebetween. The chamber space 120 may contain one or more working fluids (including a liquid phase working fluid 125 and/or a vapor phase working fluid 130) are contained, as described in greater detail herein.

Figure 1B:
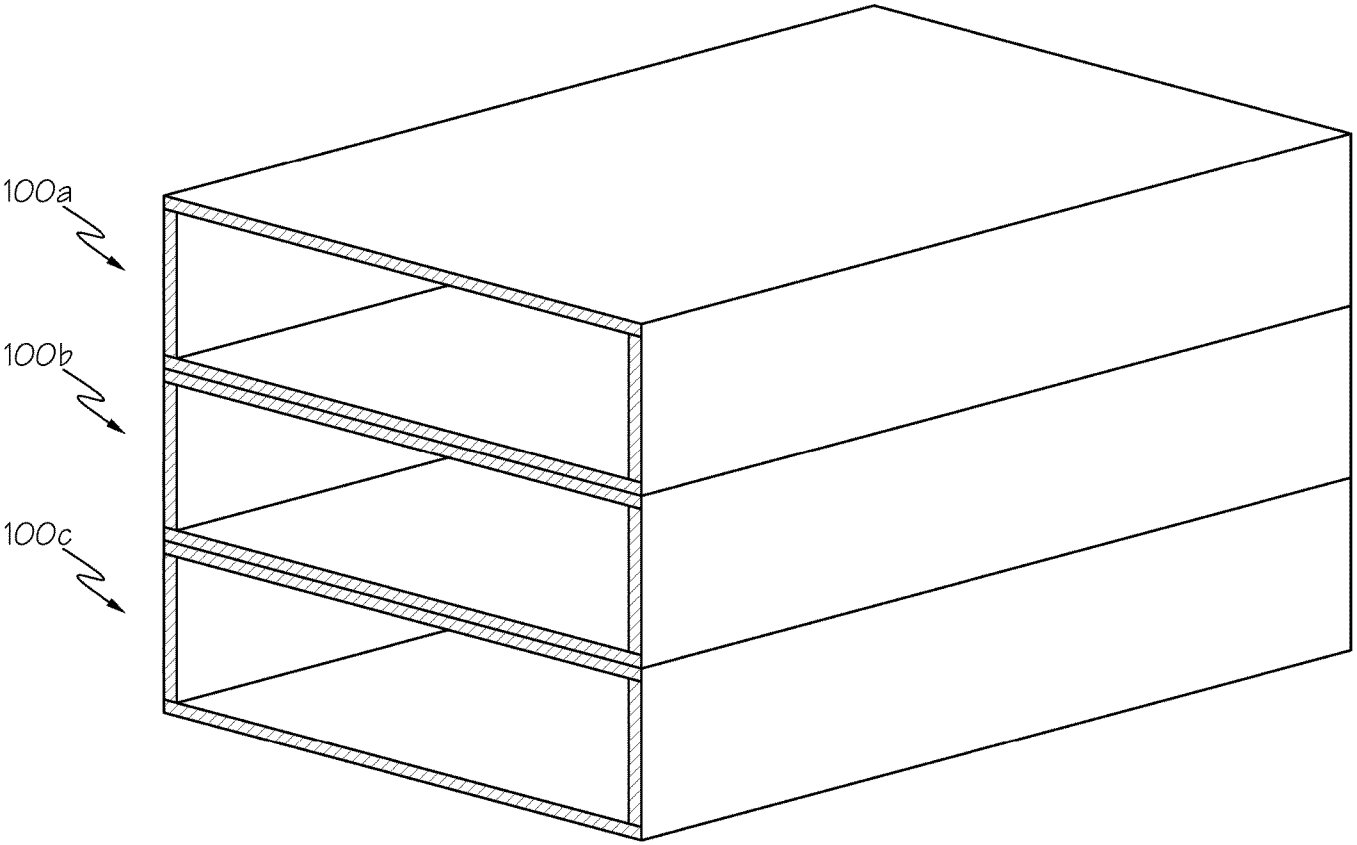
FIG. 1B depicts a side perspective view of a plurality of illustrative vapor chamber thermal diodes according to one or more embodiments shown and described herein.

While FIG. 1A depicts a single vapor chamber 100, this disclosure is not limited to such. For example, as shown in FIG. 1B, a plurality of vapor chambers 100*a*, 100*b*, 100*c* may be arranged in stacked configuration such that the vapor chambers 100*a*, 100*b*, 100*c* are connected in series. When arranged in such a configuration, heat may be transferred over a greater distance than would be possible with the single vapor chamber 100 in FIG. 1A.

Referring again to FIG. 1A, while the first surface 105 and the second surface 110 may contact each other, the present disclosure generally relates to an arrangement whereby the first surface 105 and the second surface 110 face each other at a distance D. The distance D is not limited by this disclosure, and may generally be any distance that allows fluid movement as described herein. For example, the distance D may be on the micrometer (μm) to millimeter (mm) scale. That is, the distance D may be about 1 μm to about 7 mm, including about 1 μm, about 10 μm, about 50 μm, about 100 μm, about 500 μm, about 1 mm, about 2 mm, about 3 mm, about 4 mm, about 5 mm, about 6 mm, about 7 mm, or any value or range between any two of these values (including endpoints). In some embodiments, the one or more side walls 115 may act as spacers that space the first surface 105 and the second surface 110 at the distance D apart from each other. In some embodiments, the one or more side walls 115 may be thermally insulated spacers that space the first surface 105 from the second surface 110. The side walls 115 may be thermally insulated to prevent heat flux from being transferred via the spacers between the first surface 105 and the second surface 110, and may further prevent heat flux out of the vapor chamber 100.

The first surface 105 may contain a first coating 107 thereon. In some embodiments, the second surface 110 may contain a second coating 112 thereon. In some embodiments, the first coating 107 and/or the second coating 112 may be hydrophilic such that the working fluid is attracted to the first surface 105 and/or the second surface 110, respectively. The hydrophilic material is not limited by this disclosure, and may be any type of material that exhibits attraction properties with the working fluid. Nonlimiting examples of hydrophilic materials include polymers such as polyvinyl alcohol, polyvinyl pyrrolidone or cationized cellulose, and/or the like.

In some embodiments, the first coating 107 and/or the second coating 112 may be hydrophobic such that the working fluid is repelled from the first surface 105 and/or the second surface 110, respectively. The hydrophobic material for the first coating 107 and/or the second coating 112 is not limited by this disclosure, and may be any type of material that exhibits repulsion properties with the working fluid. Certain polymers, such as, for example polypropylene and co-polyesters thereof generally have a low surface-attractive force for water. Other nonlimiting examples of hydrophobic materials include fluorine-containing polymers (e.g., fluorinated polymers such as polytetrafluoroethylene), polysiloxanes, waxes, and the like.

As will be apparent from the present disclosure, each of the first coating 107 and the second coating 112 may be hydrophilic or hydrophobic to assist in moving the working fluid between the first surface 105 and the second surface 110 to effect heat transfer. For example, if the first coating 107 is hydrophobic and the second coating 112 is hydrophilic, such surfaces may cause the working fluid to be repelled from the first surface 105 and be attracted to the second surface 110. In another example, if the first coating 107 and the second coating 112 both hydrophilic, the working fluid may be attracted to either of the first surface 105 or the second surface 110.

Figure 2:
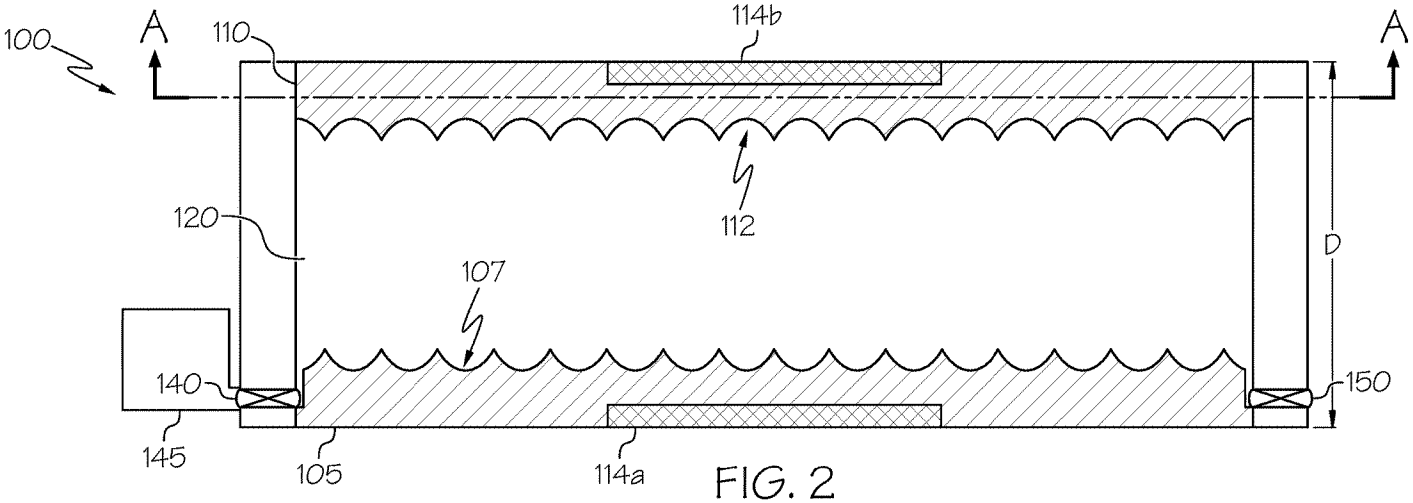
FIG. 2 depicts a cutaway side view of an illustrative vapor chamber thermal diode according to one or more embodiments shown and described herein.

Referring now to FIG. 2, in some embodiments, the vapor chamber 100 may also include a gas pump 140 fluidly coupled to the chamber space 120. The gas pump 140 may be, for example, a device that adjusts a pressure of the chamber space 120 by compressing or decompressing the chamber space 120. Such a compressing or decompressing of the chamber space 120 may be completed by inserting or removing a gas to/from the chamber space 120, such as a compressor or the like. The gas may be obtained from a tank 145 (e.g., a gas tank) that is external to the chamber space 120 and fluidly coupled to the chamber space 120. As such, the gas pump 140 selectively controls a movement of gas between the tank 145 and the chamber space 120. The gas used to fill the chamber space 120 may be any gas, particularly gases that are typically used to compress vapor chambers. Selective control of the pressure within the chamber space 120 may allow for control of the boiling point of the working fluid within the chamber space 120. For example, if a lower boiling point is desired, the pressure of the chamber space 120 may be decreased. Similarly, if a higher boiling point is desired, the pressure of the chamber space 120 may be increased. Adjustment of the boiling point may be desired, for example, to adjust the rate of heat transfer via the vapor chamber 100. For example, if increased heat flux necessitates additional heat transfer via the vapor chamber 100, the pressure can be decreased within the chamber space 120 to lower the boiling point of the working fluid that that the working fluid vaporizes more quickly, allowing heat transfer more quickly.

In some embodiments, the vapor chamber 100 may also include a fluid pump 150 fluidly coupled to the chamber space 120. The fluid pump 150 provides a means of inserting or removing the working fluid into or out of the chamber space 120. For example, if additional or less working fluid is necessary to effect heat transfer, the fluid pump 150 can be actuated to pump fluid into or out of the chamber space 120. Nonlimiting examples of the fluid pump 150 may include a positive displacement pump (e.g., a gear pump, a screw pump, a peristaltic pump, a plunger pump, etc.), an impulse pump, a velocity pump, a gravity pump, and a steam pump.

The first surface 105 and/or the second surface 110 may include one or more components for ultrasonicating the working fluid. In some embodiments, both the first surface 105 and the second surface 110 may include the one or more components for ultrasonicating the working fluid. By providing both the first surface 105 and the second surface 110 with such capabilities, the vapor chamber 100 can be reversible such that either the first surface 105 or the second surface 110 can be a hot surface, while the other surface can be a cold surface. As such, the vapor chamber 100 can be selectively switched to a particular configuration, which may be based on the particular application of the vapor chamber 100. For example, in some embodiments, the vapor chamber 100 may be configured such that the first surface 105 is the hot surface and the second surface 110 is the cold surface. In such a configuration, the one or more components for ultrasonicating the working fluid may be active on the second surface 110 (the cold surface) and inactive on the first surface 105 (the hot surface). If it is necessary to reverse the configuration of the vapor chamber 100 such that the first surface 105 is the cold surface and the second surface 110 is the hot surface, the one or more components for ultrasonicating the working fluid may be active on the first surface 105 and inactive on the second surface 110. Such a configurability of the vapor chamber 100 allows the vapor chamber 100 to be installed without respect to a particular arrangement and switched to a particular configuration depending on the particular arrangement thereof.

Figure 3:
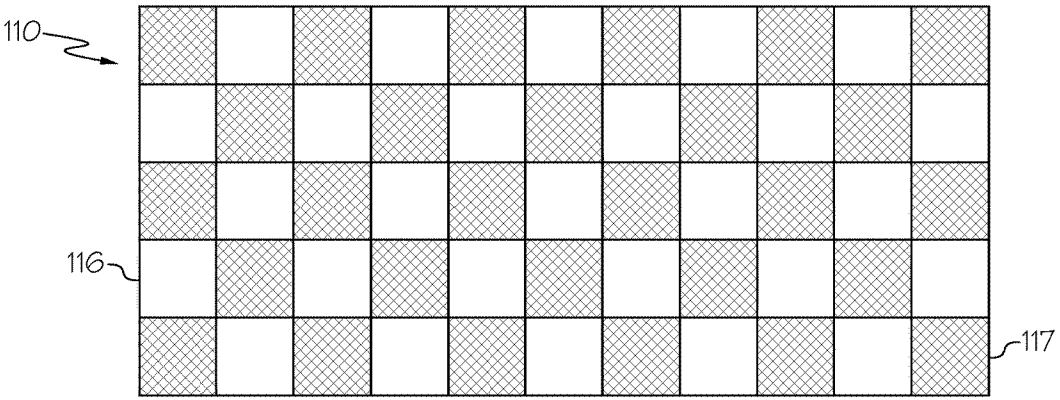
FIG. 3. depicts a cutaway view of an illustrative surface of a vapor chamber thermal diode, taken along line A-A of FIG. 2 according to one or more embodiments shown and described herein.

The one or more components for ultrasonicating the working fluid are not limited by this disclosure, and generally include any components of an ultrasonic atomizer (or other similar device) now known or later developed. For example, an ultrasonic atomizer may include at least a separating membrane and an ultrasonic oscillator. An illustrative separating membrane 116 is shown, for example, at FIG. 3. In the illustrated embodiment, the separating membrane 116 is employed to separate one or more ultrasonic oscillators 114*a*. 114*b* (FIG. 2) from the chamber space (and the working fluid therein) and transmit the ultrasonic vibrations into the working fluid. As such, a first separating membrane 116 may separate one or more first ultrasonic oscillators 114*a* from the chamber space and a second separating membrane 116 may separate one or more second ultrasonic oscillators 114*b* from the chamber space. The separating membranes 116 may include a plurality of pores 117 therein that allow the ultrasonic waves to pass therethrough to the working fluid. While FIG. 3 depicts the pores 117 in a checkerboard-type arrangement, the present disclosure is not solely limited to such. That is, the pores 117 may be arranged in any other configuration without departing from the scope of the present disclosure. The ultrasonic oscillator 114*a*, 114*b* (FIG. 2) is a piezoelectric device capable of vibrating and generating a ultrasonic wave with a frequency of about 2.0 megahertz (MHz) to about 13 MHz in response to an appropriate electrical signal applied thereto, and is configured for atomizing the working fluid into droplets. Other components and/or arrangements of the first surface and/or the second surface that can atomize the working fluid as described herein should generally be understood. As such, the present disclosure is not solely limited to the arrangement disclosed herein. Also, while FIG. 3 depicts the separating membrane 116 of the second surface 110, it should be understood that this is merely illustrative, and the separating membrane 116 may also or alternatively be located on the first surface 105.

Figure 4:
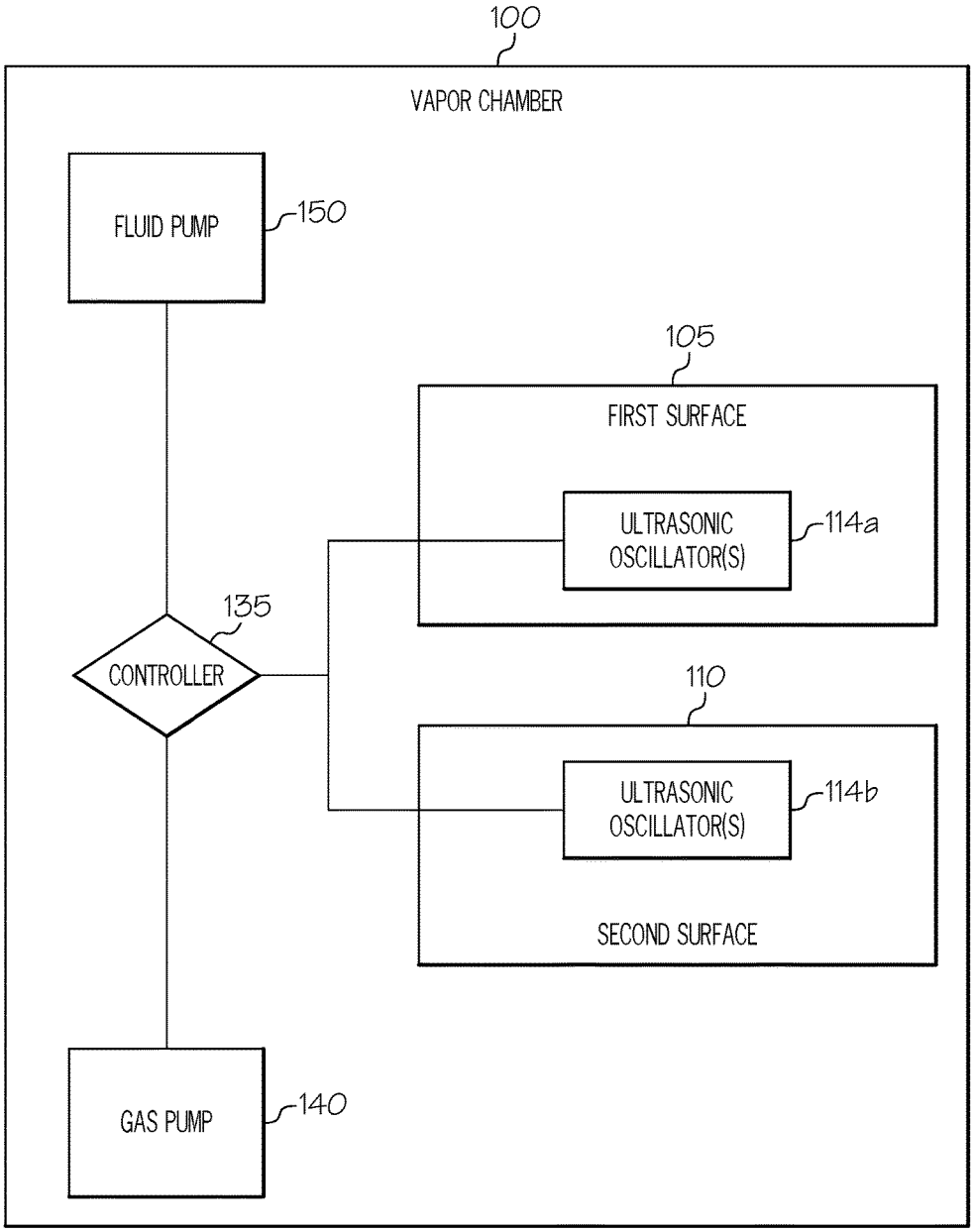
FIG. 4 depicts a schematic block diagram of illustrative components of a vapor chamber thermal diode according to one or more embodiments shown and described herein.

FIG. 4 depicts a block diagram of illustrative various components of the vapor chamber 100, including control components. As shown in FIG. 4, a controller 135 may be communicatively coupled to the ultrasonic oscillators 114*a*, 114*b* coupled to the first surface 105 and the second surface 110, respectively. The controller 135 may also be communicatively coupled to the gas pump 140 and/or the tank 145 to direct pressurization and fill of working fluid, as described in greater detail herein.

The ultrasonic oscillators 114*a*, 114*b* may be selectively controlled by the controller 135 based on the orientation of the vapor chamber 100 and the desired movement of heat flux. For example, if the vapor chamber 100 is arranged such that the first surface 105 is a hot surface and the second surface 110 is a cold surface, the ultrasonic oscillators 114*b* coupled to the second surface 110 may be activated and controlled by the controller 135. In contrast, if the vapor chamber 100 is arranged such that the first surface 105 is a cold surface and the second surface 110 is a hot surface, the ultrasonic oscillators 114*a* incorporated in the first surface 105 may be activated.

Figure 5:
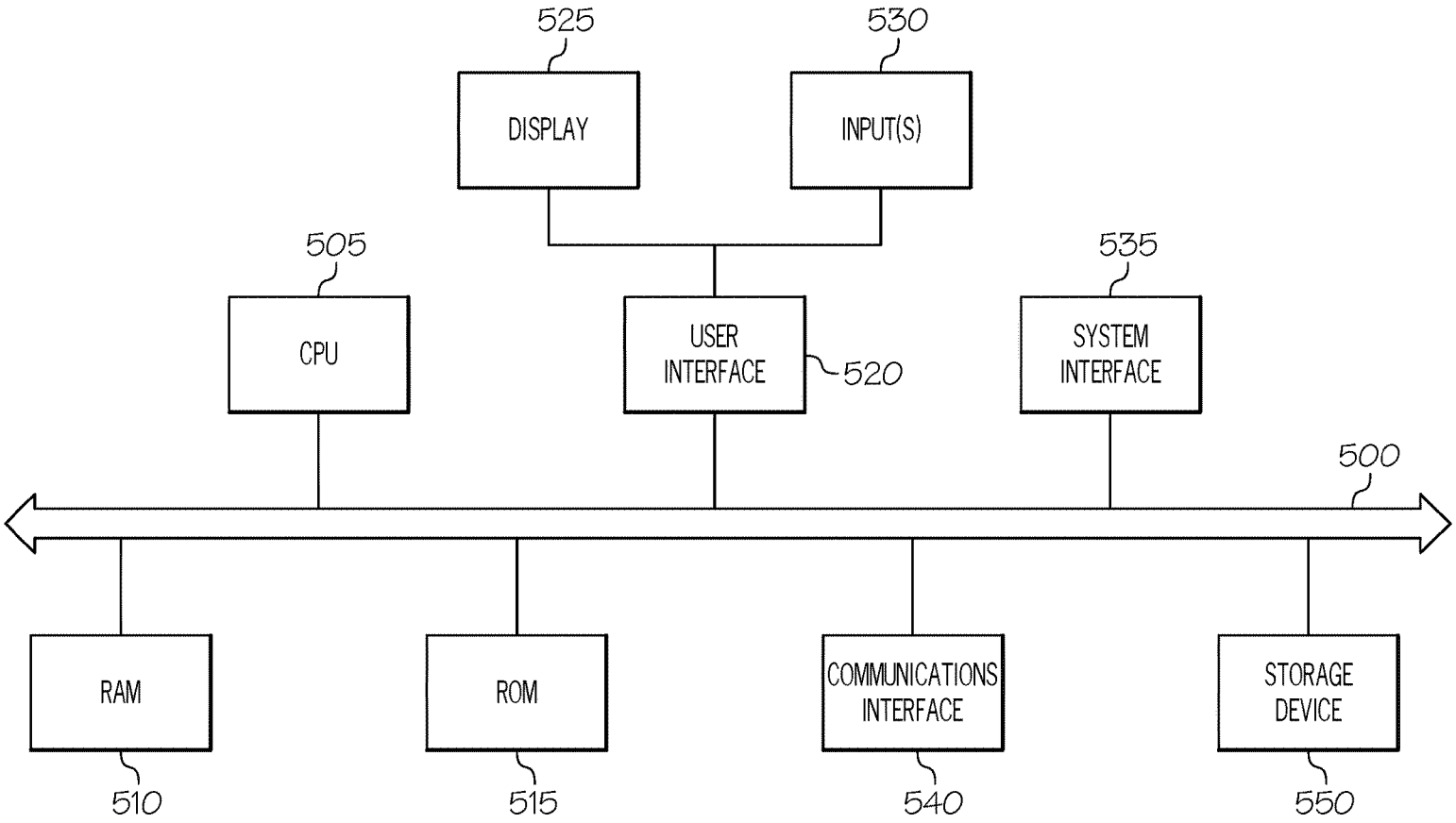
FIG. 5 depicts a schematic block diagram of illustrative computer processing hardware components according to one or more embodiments shown and described herein.

The controller 135 may also include a plurality of hardware components, particularly components that allow the controller 135 to selectively control activation of the ultrasonic oscillators 114*a* incorporated within the first surface 105, the ultrasonic oscillators 114*b* incorporated within the second surface 110, the gas pump 140, and/or the tank 145 as described herein. Illustrative hardware components of the controller 135 are depicted in FIG. 5. A bus 500 may interconnect the various components. A processing device, such as a computer processing unit (CPU) 505, may be the central processing unit of the computing device, performing calculations and logic operations required to execute a program. The CPU 505, alone or in conjunction with one or more of the other elements disclosed in FIG. 5, is an illustrative processing device, computing device, processor, or combination thereof, as such terms are used within this disclosure. Memory, such as read only memory (ROM) 515 and random access memory (RAM) 510, may constitute illustrative memory devices (i.e., non-transitory processor-readable storage media). Such memory 510, 515 may include one or more programming instructions thereon that, when executed by the CPU 505, cause the CPU 505 to complete various processes, such as the processes described herein. Optionally, the program instructions may be stored on a tangible computer-readable medium such as a compact disc, a digital disk, flash memory, a memory card, a USB drive, an optical disc storage medium, such as a Blu-Ray™ disc, and/or other non-transitory processor-readable storage media.

A storage device 550, which may generally be a storage medium that is separate from the RAM 510 and the ROM 515, may contain a repository or the like for storing the various information and features described herein. For example, the storage device 550 may store information regarding the positioning and orientation of the vapor chamber 100. The storage device 550 may be any physical storage medium, including, but not limited to, a hard disk drive (HDD), memory, removable storage, and/or the like. While the storage device 550 is depicted as a local device, it should be understood that the storage device 550 may be a remote storage device, such as, for example, a remote server computing device or the like.

An optional user interface 520 may permit information from the bus 500 to be displayed on a display 525 in audio, visual, graphic, or alphanumeric format. Moreover, the user interface 520 may also include one or more inputs 530 that allow for transmission to and receipt of data from input devices such as a keyboard, a mouse, a joystick, a touch screen, a remote control, a pointing device, a video input device, an audio input device, a haptic feedback device, and/or the like. Such a user interface 520 may be used, for example, to allow a user to interact with the controller 135 to change various settings, such as adjust an amount of working fluid, adjust a pressure to control the boiling point of the working fluid, control the direction of the vapor chamber 100 (e.g., to activate the ultrasonic oscillator 114*a* of the first surface 105 or the ultrasonic oscillator 114*b* of the second surface 110), and/or the like.

A system interface 535 may generally provide the controller 135 with an ability to interface with one or more of the components of the vapor chamber 100, including, but not limited to, the ultrasonic oscillators 114*a*, 114*b*, the gas pump 140, and/or the tank 145. Communication with the components of the vapor chamber 100 may occur using various communication ports. An illustrative communication port may be attached to a communications network, such as an intranet, a local network, a direct connection, and/or the like.

A communications interface 545 may generally provide the controller 135 with an ability to interface with one or more components that are external to the vapor chamber 100, such as, for example, other vapor chambers, other heat control devices, components coupled to the vapor chamber 100, and/or the like. Communication with the external components may occur using various communication ports. An illustrative communication port may be attached to a communications network, such as the Internet, an intranet, a local network, a direct connection, and/or the like.

Figure 6:
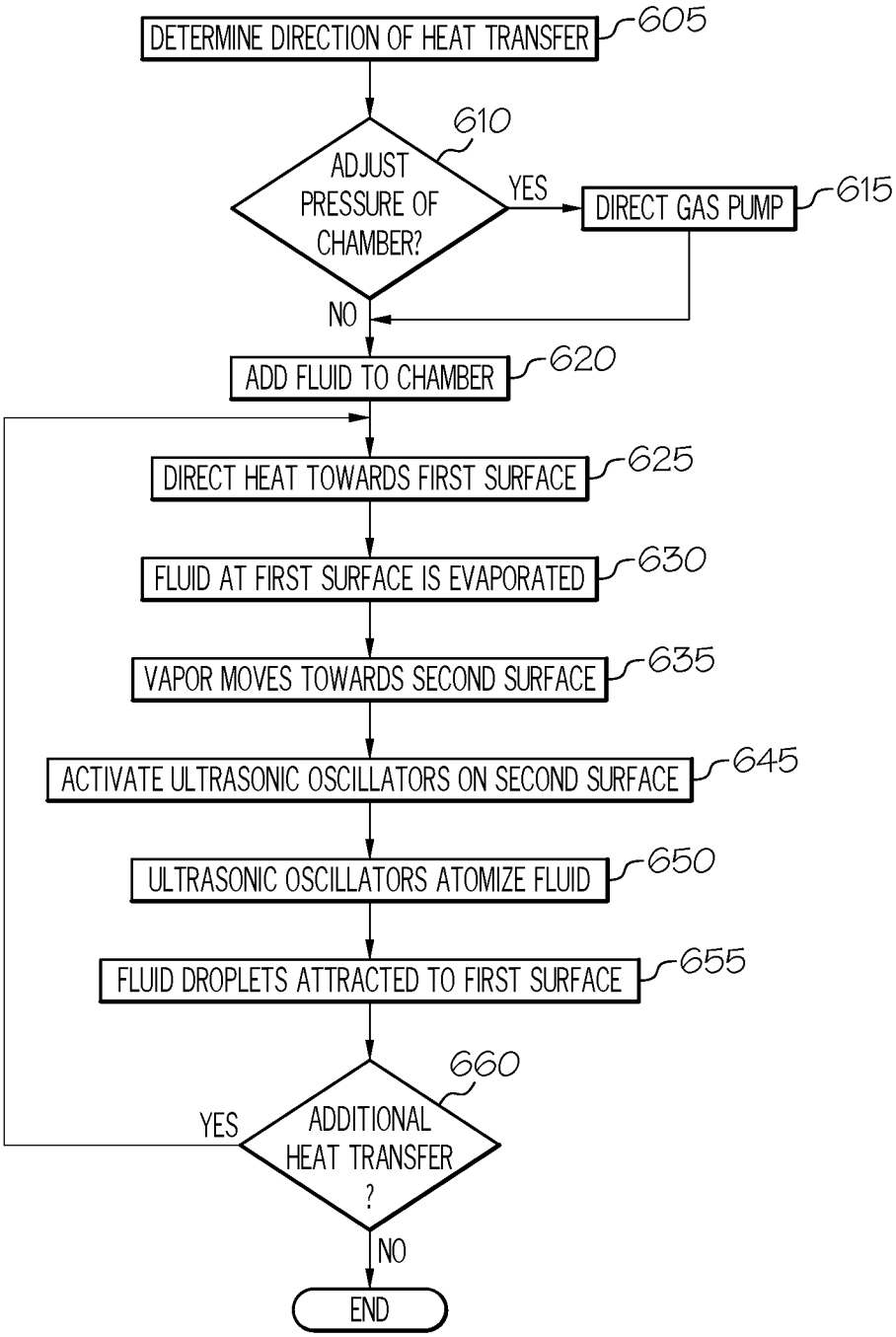
FIG. 6 depicts a flow diagram of an illustrative method of operating a vapor chamber thermal diode according to one or more embodiments shown and described herein.

FIG. 6 depicts a flow diagram of an illustrative method of operating the vapor chamber. The steps depicted in FIG. 6 assume that the vapor chamber has been installed in a location at which the control of heat flux is desired. At step 605, a determination may be made as to the direction of heat transfer. That is, the determination serves to determine which of the first surface and the second surface is the hot surface and which is the cold surface. For the purposes of describing FIG. 6, the first surface is the hot surface and the second surface is the cold surface.

At step 610, a determination is made as to whether the pressure of the vapor chamber needs to be adjusted. As previously explained herein, the pressure may be adjusted to change the boiling point of the working fluid, which may be used to increase or decrease the rate of the heat transfer. If the pressure within the vapor chamber needs to be adjusted, the gas pump may be directed at step 615. That is, a control signal may be transmitted to the gas pump to direct the gas pump to compress or decompress the vapor chamber, as described in greater detail herein.

Once the pressure has been adjusted (or if no pressure adjustment is necessary), the working fluid may be added to the vapor chamber at step 620. Adding the working fluid to the vapor chamber may include, for example, transmitting a control signal to the fluid pump directing the fluid pump to pump the working fluid. Once a sufficient amount of working fluid has been added to the vapor chamber, the process may proceed to step 625. A sufficient amount of working fluid may be determined based on the volume of the chamber space and/or an amount of working fluid that is sufficient for heat transfer as described herein.

Figure 7A:
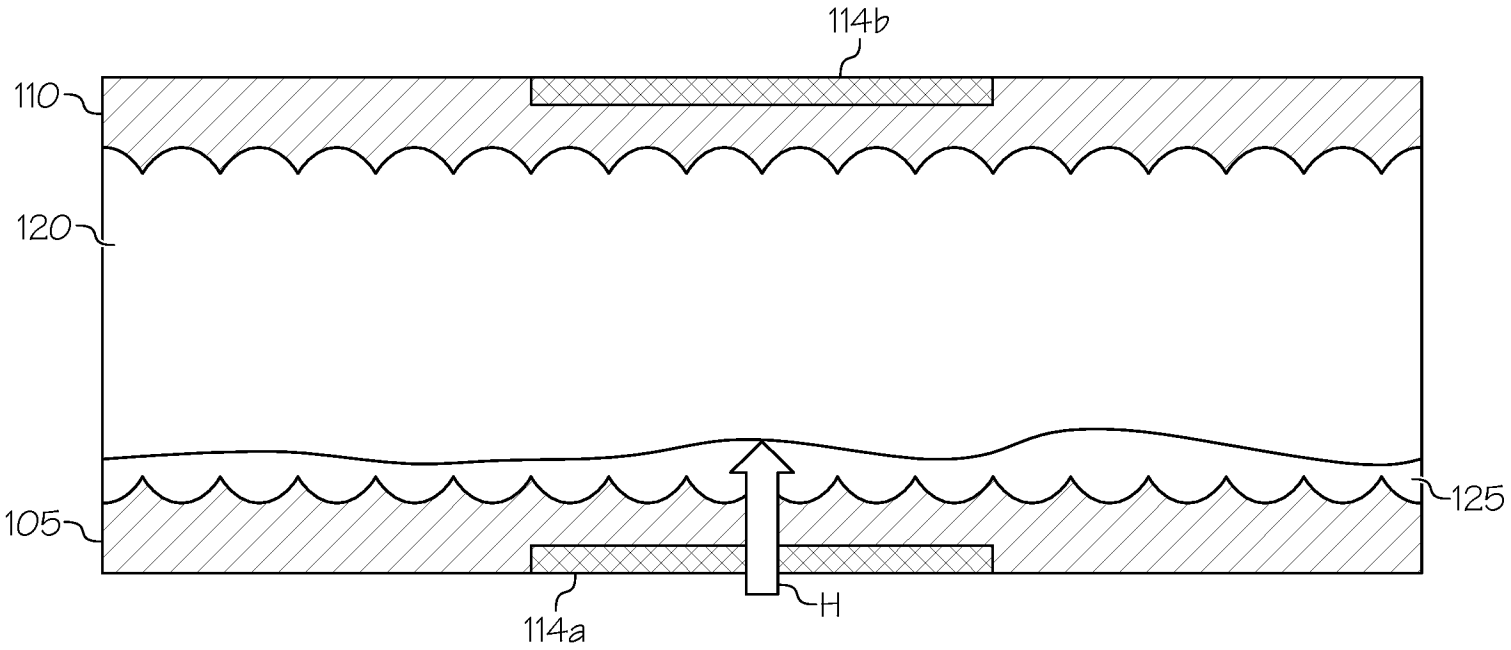
FIG. 7A depicts a schematic view of an application of heat to an illustrative vapor chamber thermal diode having fluid therein according to one or more embodiments shown and described herein.
Figure 7B:
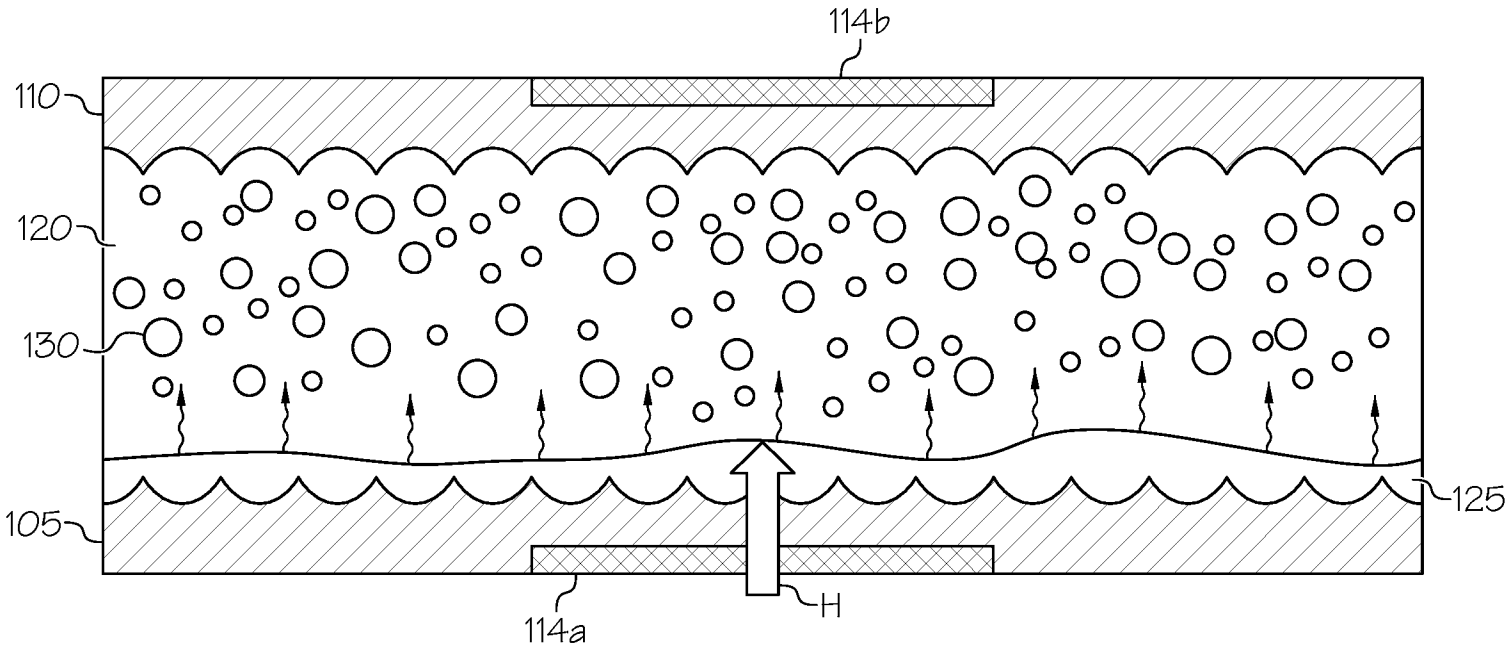
FIG. 7B depicts a schematic view of a vaporization of fluid in an illustrative vapor chamber thermal diode according to one or more embodiments shown and described herein.

At step 625, the heat to be transferred may be directed at the first surface. For example, as shown in FIG. 7A, the heat flux H (indicated by the arrow in FIG. 7A) may be applied to the first surface 105 by directing the heat flux H from a device that is thermally coupled to the first surface. Referring to FIGS. 6 and 7B, the heat flux H causes the first surface 105 to increase in temperature, which heats and causes the liquid phase working fluid 125 that is adjacent to the first surface 105 to evaporate at step 630. At step 635, the vapor phase working fluid 130 that results from evaporation of the liquid phase working fluid 125 moves toward the second surface 110. As such, the vapor phase working fluid 130 contacts and condenses on the second surface 110. In some embodiments, this movement may be due to an attraction between the vapor phase working fluid 130 and the second surface 110 because of a hydrophilic coating on the second surface 110, as described in greater detail herein. The condensation of the vapor phase working fluid 130 causes the heat flux to be transferred to the second surface 110, which may be thermally coupled to another device to further transfer the heat flux. As such, the condensed working fluid is cooled.

Figure 7C:
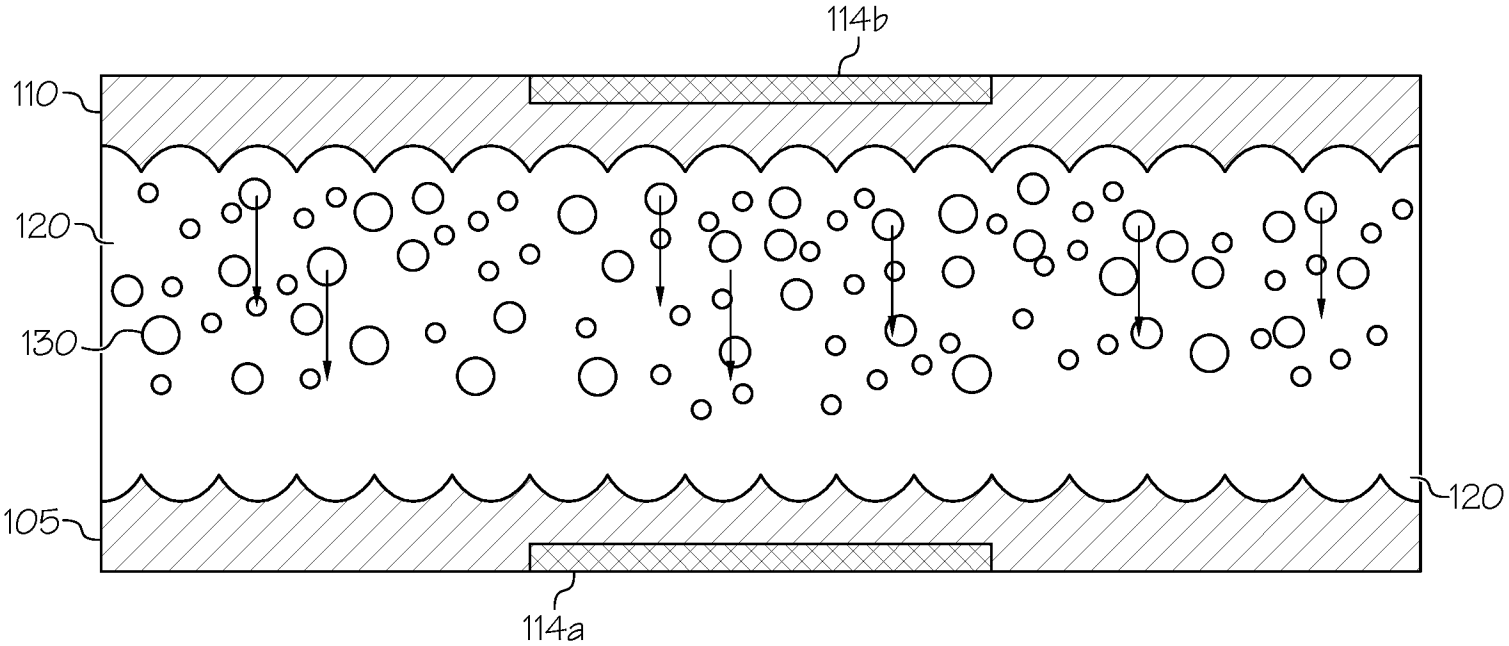
FIG. 7C depicts a schematic view of an ultrasonication of fluid in an illustrative vapor chamber thermal diode according to one or more embodiments shown and described herein.

Referring to FIGS. 6 and 7C, in contrast to other vapor chambers that utilize a wick or other device to return the condensed working fluid to a hot surface, the ultrasonic oscillator 114*b* coupled to the second surface 645 is activated at step 645. Activation of the ultrasonic oscillator 114*b* causes the condensed fluid at the second surface 110 to atomize into droplets at step 650. As such, the resultant droplets of working fluid are cooled because the heat has been transferred to the second surface 110.

At step 655, the cooled, droplets of working fluid are attracted towards the first surface 105. This attraction may generally be due to the hydrophilic coating on the first surface 105, as described in greater detail herein. The orientation of the vapor chamber 100 is not relevant to the movement of the working fluid. That is, the working fluid can be atomized into droplets and attracted to the first surface 105 regardless of how the vapor chamber 100 is oriented, as external forces such as gravitational pull or centrifugal force will not prevent the attraction between the working fluid and the first surface 105 from occurring.

At step 660, a determination may be made as to whether additional heat transfer is necessary. If not, the process may end. If additional heat transfer is necessary, the process may return to step 625 and repeat steps 625-660.

In embodiments where a plurality of vapor chambers are coupled in series (e.g., as depicted in FIG. 1B), the processes described with respect to FIG. 6 may be similar in how heat is transferred between the first surface 105 and the second surface 110 of each vapor chamber. In addition, when the working fluid condenses on the second surface 110 of a first chamber, the heat from the condensed working fluid is transferred from the second surface 110 of the first chamber to the first surface 105 of the second chamber, which heats the working fluid in the second chamber and causes the fluid to evaporate. This process may continue through each of the vapor chambers in the plurality of vapor chambers in the same manner.

As previously described herein, either of the first surface 105 or the second surface 110 may be used as the hot surface because the components coupled to both surfaces are identical. As such, the processes described with respect to FIG. 6 may be reversed such that the second surface 110 heats the working fluid and causes it to evaporate and the first surface 105 condenses the working fluid and atomizes the working fluid into droplets to return it to the first surface 105. As such, the vapor chamber 100 can be installed in any orientation and actively switched depending on the desired direction of heat transfer.

Accordingly, it should now be understood that the vapor chamber described herein can be oriented in any manner to selectively direct heat flux in any desired direction. The vapor chamber described herein includes a first surface and a second surface, each of which may contain a hydrophilic coating thereon and may be coupled to ultrasonic oscillators that are used to atomize cooled working fluid into droplets depending on the direction of heat transfer through the vapor chamber. Such a configuration of the vapor chamber allows it to be mounted to a surface regardless of external forces that may be applied, thereby making the vapor chamber suitable for applications where movement is common, such as vehicular applications. In addition, such a configuration allows the vapor chamber to be actively switched based on a desired direction of heat flux, which is easily reversible.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A heat transfer apparatus comprising:

a vapor chamber comprising a first surface and a second surface, wherein:

the first surface and the second surface define a chamber space, and each of the first surface and the second surface comprises a hydrophilic coating;

one or more first ultrasonic oscillators coupled to the first surface;

one or more second ultrasonic oscillators coupled to the second surface; and a controller comprising a non-transitory, processor-readable storage medium storing programming instructions for selectively activating the one or more first ultrasonic oscillators or the one or more second ultrasonic oscillators based on an intended direction of heat flux.

2. The heat transfer apparatus of claim 1, further comprising a fluid pump that pumps a working fluid into the chamber space.

3. The heat transfer apparatus of claim 1, further comprising a gas pump that adjusts a pressure of the chamber space.

4. The heat transfer apparatus of claim 3, further comprising a gas tank fluidly coupled to the chamber space, wherein the gas pump selectively controls movement of gas between the gas tank and the chamber space.

5. The heat transfer apparatus of claim 1, wherein the vapor chamber further comprises one or more side walls positioned between the first surface and the second surface, wherein the one or more side walls, the first surface, and the second surface define the chamber space.

6. The heat transfer apparatus of claim 5, wherein the one or more side walls are spacers that space the first surface a distance apart from the second surface.

7. The heat transfer apparatus of claim 5, wherein the one or more side walls are thermally insulated spacers.

8. The heat transfer apparatus of claim 1, further comprising:

a first separating membrane positioned between the one or more first ultrasonic oscillators and the chamber space;

a second separating membrane positioned between the one or more second ultrasonic oscillators and the chamber space, wherein the first separating membrane and the second separating membrane each comprise a plurality of pores that allow ultrasonic waves produced by the one or more first ultrasonic oscillators and the one or more second ultrasonic oscillators to pass through the separating membrane.

9. The heat transfer apparatus of claim 1, wherein the vapor chamber is a first vapor chamber coupled in series to a second vapor chamber.

10. A method of directing heat transfer, the method comprising:

designating a first surface of a vapor chamber as a hot surface based on a determined direction of heat transfer, the first surface comprising a hydrophilic coating;

directing heat from an external source towards the first surface, wherein the heat causes a working fluid adjacent to the first surface to evaporate and condense on a second surface to form a condensed working fluid, the second surface comprising a hydrophilic coating; and activating one or more ultrasonic oscillators coupled to the second surface, wherein the one or more ultrasonic oscillators cause the condensed working fluid to atomize and form droplets of working fluid, wherein:

the droplets of working fluid are attracted to the hydrophilic coating on the first surface, and heat is transferred from the first surface to the second surface based on movement of the working fluid.

11. The method of claim 10, further comprising adjusting an internal pressure of the vapor chamber to change a boiling point of the working fluid.

12. The method of claim 11, wherein adjusting the internal pressure comprises directing a gas pump to insert gas into or remove gas from the vapor chamber from a gas tank fluidly coupled to a chamber space of the vapor chamber.

13. The method of claim 10, further comprising adding the working fluid to the vapor chamber prior to directing the heat.

14. The method of claim 10, further comprising:

removing the heat from the first surface;

applying heat to the second surface to cause working fluid adjacent to the second surface to evaporate and condense;

deactivating the one or more ultrasonic oscillators coupled to the second surface; and activating one or more ultrasonic oscillators coupled to the first surface to form the droplets of working fluid at the first surface, wherein the heat is transferred from the second surface to the first surface based on the movement of the droplets of working fluid.

15. An ultrasonic thermal diode comprising:

a vapor chamber comprising a first surface, a second surface and one or more side walls spaced between the first surface and the second surface, wherein:

the first surface, the second surface, and the one or more side walls define a chamber space that contains a working fluid, and each of the first surface and the second surface comprises a hydrophilic coating;

one or more ultrasonic oscillators coupled to the second surface, the ultrasonic oscillators separated from the chamber space by a separating membrane;

a controller comprising a processing device and a non-transitory, processor-readable storage medium, the non-transitory, processor-readable storage medium comprising one or more programming instructions that, when executed, cause the processing device to:

designate the first surface as a hot surface based on a determined direction of heat transfer, direct heat towards the first surface, wherein the heat causes the working fluid adjacent to the first surface to evaporate and condense on the second surface to form a condensed working fluid, and activate the one or more ultrasonic oscillators coupled to the second surface to form droplets of working fluid from the condensed working fluid, wherein:

the droplets of working fluid are attracted to the hydrophilic coating of the first surface, and heat is transferred from the first surface to the second surface based on movement of the working fluid.

16. The ultrasonic thermal diode of claim 15, further comprising a fluid pump, wherein the one or more programming instructions that, when activated, further cause the processing device to direct the fluid pump to pump the working fluid into the chamber space prior to directing heat.

17. The ultrasonic thermal diode of claim 15, further comprising a gas tank fluidly coupled to the chamber space and a gas pump that selectively controls movement of gas between the gas tank and the chamber space.

18. The ultrasonic thermal diode of claim 17, wherein the one or more programming instructions that, when executed, further cause the processing device to adjust an internal pressure of the chamber space to change a boiling point of the working fluid by directing the gas pump to insert gas into or remove gas from the chamber space.

19. The ultrasonic thermal diode of claim 15, wherein the one or more side walls are thermally insulated spacers.

20. The ultrasonic thermal diode of claim 15, wherein the vapor chamber is a first vapor chamber coupled in series to a second vapor chamber.

* * * * *